US008093487B2

(12) United States Patent
Kimerer, Jr.

(10) Patent No.: US 8,093,487 B2
(45) Date of Patent: Jan. 10, 2012

(54) REMOVABLE PROTECTIVE NOSE COVER

(75) Inventor: Neil B. Kimerer, Jr., State College, PA (US)

(73) Assignee: The Penn State Research Foundation, University Park, PA (US)

( * ) Notice: Subject to any disclaimer, the term of this patent is extended or adjusted under 35 U.S.C. 154(b) by 516 days.

(21) Appl. No.: 12/360,981

(22) Filed: Jan. 28, 2009

(65) Prior Publication Data

US 2010/0229774 A1 Sep. 16, 2010

Related U.S. Application Data

(60) Provisional application No. 61/025,181, filed on Jan. 31, 2008.

(51) Int. Cl.
*F42B 15/22* (2006.01)

(52) U.S. Cl. ..... 114/20.1; 114/22; 102/390; 102/399

(58) Field of Classification Search ..... 114/20.1, 114/22; 102/390, 399, 406, 398, 377
See application file for complete search history.

(56) References Cited

U.S. PATENT DOCUMENTS

| | | | | | |
|---|---|---|---|---|---|
| 2,889,772 | A | * | 6/1959 | Howard | 102/390 |
| 3,135,204 | A | * | 6/1964 | Menichelli et al. | 102/399 |
| 3,205,822 | A | * | 9/1965 | Gustafsson et al. | 102/399 |
| 3,279,405 | A | * | 10/1966 | Billmeyer | 114/20.1 |
| 3,391,885 | A | * | 7/1968 | Genco | 206/521 |
| 3,477,376 | A | * | 11/1969 | Blatt et al. | 102/399 |
| 3,601,055 | A | * | 8/1971 | Crockett | 102/377 |
| 3,674,227 | A | * | 7/1972 | Jacobson et al. | 244/121 |
| 3,706,281 | A | * | 12/1972 | Hatakeyama | 102/378 |
| 3,867,893 | A | | 2/1975 | Saholt et al. | |
| 4,593,637 | A | | 6/1986 | Klee | |
| 4,638,737 | A | * | 1/1987 | McIngvale | 102/489 |
| 4,788,914 | A | | 12/1988 | Frater | |
| 4,867,357 | A | * | 9/1989 | Inglis et al. | 244/121 |
| 4,951,587 | A | * | 8/1990 | Warner et al. | 114/20.1 |
| 5,012,717 | A | * | 5/1991 | Metersky et al. | 89/1.11 |
| 5,235,128 | A | | 8/1993 | Hardesty et al. | |
| 5,929,370 | A | * | 7/1999 | Brown et al. | 102/399 |
| 7,082,878 | B2 | * | 8/2006 | Facciano et al. | 102/377 |
| 7,093,799 | B1 | * | 8/2006 | Dulat et al. | 244/121 |
| 7,661,625 | B2 | * | 2/2010 | Rieger et al. | 244/121 |
| 2005/0000383 | A1 | * | 1/2005 | Facciano et al. | 102/377 |
| 2011/0036261 | A1 | * | 2/2011 | Krisher | 102/378 |
| 2011/0192308 | A1 | * | 8/2011 | Fisch et al. | 102/377 |

* cited by examiner

*Primary Examiner* — Benjamin P Lee
(74) *Attorney, Agent, or Firm* — Gifford, Krass, Sprinkle, Anderson & Citkowski, P.C.

(57) ABSTRACT

A removable protective nose cover for a submersible structure having a nose section is disclosed. The removable protective nose cover can include a plurality of shell members, each of the shell members having a forward end and an aft end. Each shell member can also be dimensioned to fit adjacent to and around the nose section of the submersible structure and thereby form a protective shell. A central nose member having a locking member can also be included, the locking member being operable to attach the central nose member to each of the forward ends of the shell members. The aft ends of the shell members can be attached to each other using a plurality of attachment clips such that the attachment of the central nose member to each of the forward ends of the shell members and the attachment of the adjacent aft ends of the shell members form the removable protective nose cover for the submersible structure. The attachment clips can be operable to release the plurality of shell members from being held adjacent to the submersible structure when the structure moves through a liquid at a predefined speed.

17 Claims, 3 Drawing Sheets

Fig-4
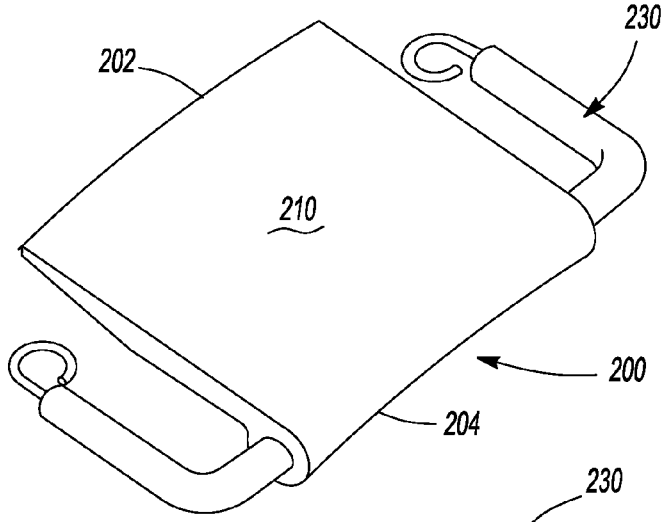
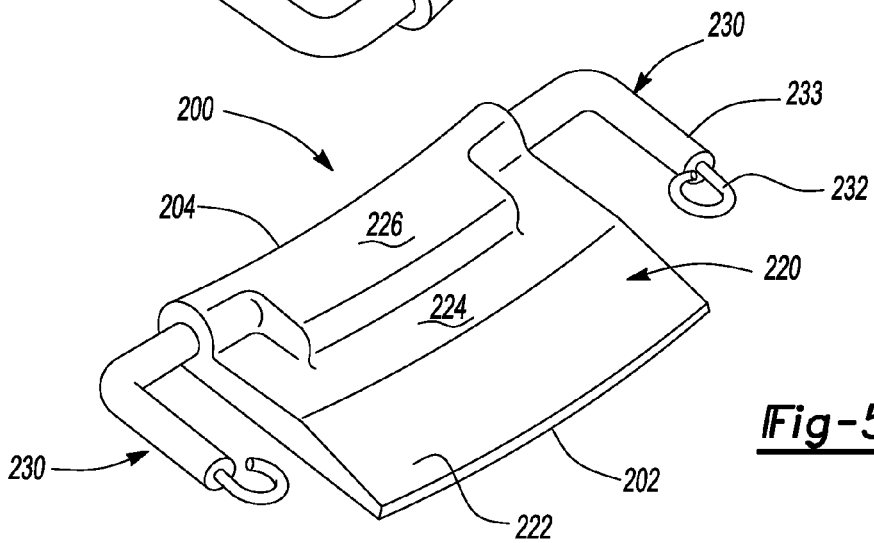
Fig-5
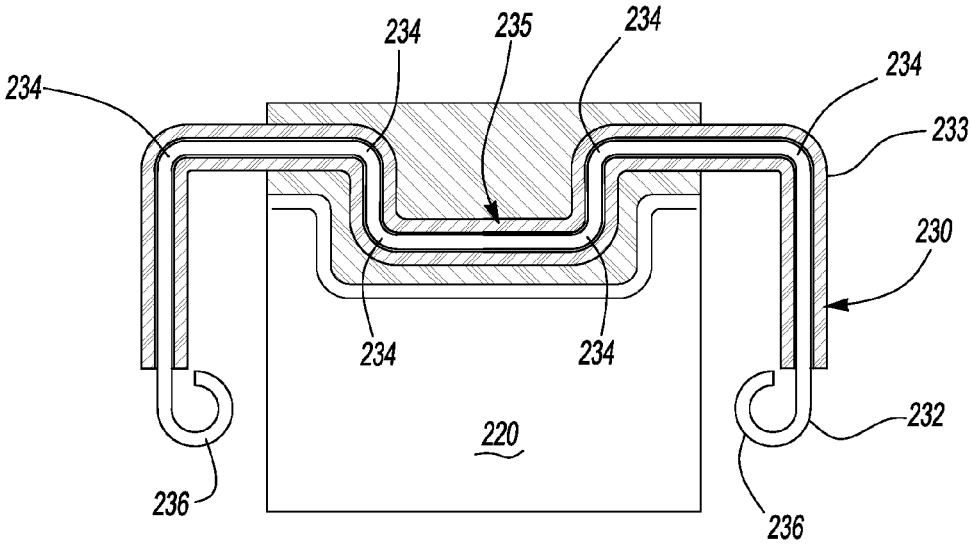
Fig-6

REMOVABLE PROTECTIVE NOSE COVER

CROSS-REFERENCE TO RELATED APPLICATIONS

This application claims priority of U.S. Provisional Patent Application Ser. No. 61/025,181 filed Jan. 31, 2008, which is incorporated herein by reference.

GOVERNMENT INTEREST

This invention was made with government support under Contract No. N00024-02-D-6604 ordered by the U.S. Office of Naval Research. The government has certain rights in the invention.

FIELD OF THE INVENTION

The present invention relates to a removable protective nose cover for a submersible structure, and more particularly, a removable protective nose cover for a submersible structure.

BACKGROUND OF THE INVENTION

Weapons such as torpedoes can be dropped into a body of water from a high altitude by a helicopter, fixed wing aircraft and the like in an effort to damage and/or destroy an intended target. The impact of the water on sensitive array components within a nose section of the weapon can cause damage thereto and result in the failure of the weapon. Heretofore weapons have placed a protective nose cover over the forward end of the weapon in order to mitigate the water impact forces and prevent damage to the instrumentation. This force reduction is achieved primarily through streamlining of the nose shape through the addition of a pointed shape provided by the nose cover. However, for the sensitive array components to function properly, the protective nose cover must come off or be removed after the weapon has entered the water. One method that has been used to accomplish this task has been a cover that breaks up or fragments upon impact of the weapon with the water. However, limited success has been demonstrated by such a method since the nose cover has to be durable enough to protect the instrumentation during transport and from impact by other flying objects such as birds, and yet still provide reliable fracture upon water entry/impact.

In particular, frangible nose covers rely on the fracture strength of the material of construction in their design in that if the fracture strength is exceeded upon impact and/or entry into water, the nose cover fractures and the cover falls away from the weapon. However, the fracture strength of a given material can be highly variable, thus making such a protective nose cover that will fracture under specific conditions very difficult.

Heretofore frangible nose covers have been principally made from two types of materials—plastics and ceramics. The fracture strength of a given plastic typically varies with temperature, humidity, and time. Since none of these variables are controllable in an end use scenario, whether or not a plastic frangible nose cover fractures upon impact with water is highly variable. In contrast, ceramics are relatively stable with temperature, humidity and time. However small imperfections within or on a ceramic body can cause very large changes in the body's fracture strength. In summary, previous research and development of removable protective nose covers has been met with limited success.

As such, a protective nose cover that provides adequate protection during transport of the weapon and yet provides reliable removal upon entry into the water would be desirable.

SUMMARY OF THE INVENTION

A removable protective nose cover for a submersible structure having a nose section is disclosed. The removable protective nose cover can include a plurality of shell members, each of the shell members having a forward end and an aft end. Each shell member can be dimensioned to fit adjacent to and around the nose section of the submersible structure and thereby form a protective shell. A central nose member having a locking member can also be included, the locking member being operable to attach the central nose member to each of the forward ends of the shell members. The aft ends of the shell members can be attached to each other using a plurality of attachment clips such that the attachment of the central nose member to each of the forward ends of the shell members and the attachment of the adjacent aft ends of the shell members form the removable protective nose cover for the submersible structure.

The removable protective nose cover can have at least one submerged inlet duct that is at least partially within one of the shell members. In some instances, the submerged inlet duct can be formed by two attached and adjacent shell members and may or may not be proximate to the aft ends of the two attached and adjacent shell members. One of the attachment clips can cover at least part of the submerged inlet duct and be shaped such that when a fluid flows through the duct a differential pressure is provided to opposite sides of the clip. The differential pressure can result in the clip being moved from a closed position to an open position, the open position of the clip affording for the shell members being released from positions adjacent to the submersible structure and removal of the nose cover being provided.

A process for removing the protective nose cover from the submersible structure can include providing the structure and providing the protective nose cover as detailed above. The plurality of shell members, the central nose member and the plurality of attachment clips are assembled about the submersible structure in order to form the protective nose cover with a plurality of submerged inlet ducts therewithin. Thereafter, the submersible structure can be placed into a liquid and moved through the liquid at a predefined speed. As the liquid passes through the plurality of submerged inlet ducts, a pressure differential is created on opposite sides of each of the plurality of attachment clips, the pressure differential exceeding a predefined value such that the clips are forced to move from the closed position to the open position. When the clips move to the open position, the plurality of shell members are no longer constrained to fit adjacent to the submersible structure, and in combination with the fluid flow about the structure and the shell members, the protective nose cover is removed.

BRIEF DESCRIPTION OF THE DRAWINGS

FIG. 4 is a top perspective view of an attachment clip;

FIG. 5 is a bottom perspective view of the attachment clip shown in FIG. 4; and FIG. 6 is a top cross-sectional view of the clip shown in FIG. 5.

DETAILED DESCRIPTION OF THE INVENTION

The present invention discloses a removable protective nose cover for a submersible structure having a nose section. In some instances, the submersible structure can be a weapon. As such, the present invention has utility as a component for a weapon.

The invention can be applied to applications other than weapons and thereby afford protection to any sensitive instrumentation package(s) that needs to be delivered through a gas medium into a liquid at high energy. For example and for illustrative purposes only, oceanographic instrument packages, such as those that monitor water conditions in lakes and oceans, could be dropped from high altitude aircraft and use the removable protective nose cover disclosed herein to protect instrumentation within the package. It can also be applied to a submersed canister containing a weapon or instrumentation package that must break through a barrier in order to be sent on its mission. The protective cover would prevent damage to the package while the barrier is being penetrated and subsequently come off the package after a specified velocity in a liquid (such as water) has been reached.

The removable protective nose cover can include a plurality of shell members, each shell member having a forward end and an aft end. In addition, each shell member has a shape that is complementary to the nose section of the submersible structure and thereby affords for the plurality of shell members to fit adjacent to and around the nose section of the structure. This plurality of shell members, when assembled, forms a protective shell around the nose section of the submersible structure.

A central nose member can also be included, the nose member operable to attach to the forward ends of each of the plurality of shell members and thereby hold the forward ends of the shell members in a desired configuration. In some instances, the central nose member has a locking element that is operable to attach the central nose member to each of the forward ends of the plurality of shell members. Proximate to the aft end of each shell member can be an attachment clip that is operable to attach adjacent aft ends of adjacent shell members such that the aft ends are also held in a desirable configuration.

The attachment clips can be positioned proximate and/or adjacent to a submerged inlet duct that is proximate to the aft end of the shell member. The clip can have a shape such that the flow of water into the submerged inlet duct provides a high static pressure against the clip. The high static pressure is sufficient to release the clip, i.e. force the clip from a closed position to an open position, the open position resulting in the separation of corresponding shell members away from the nose section of the submersible structure.

Figure 1:
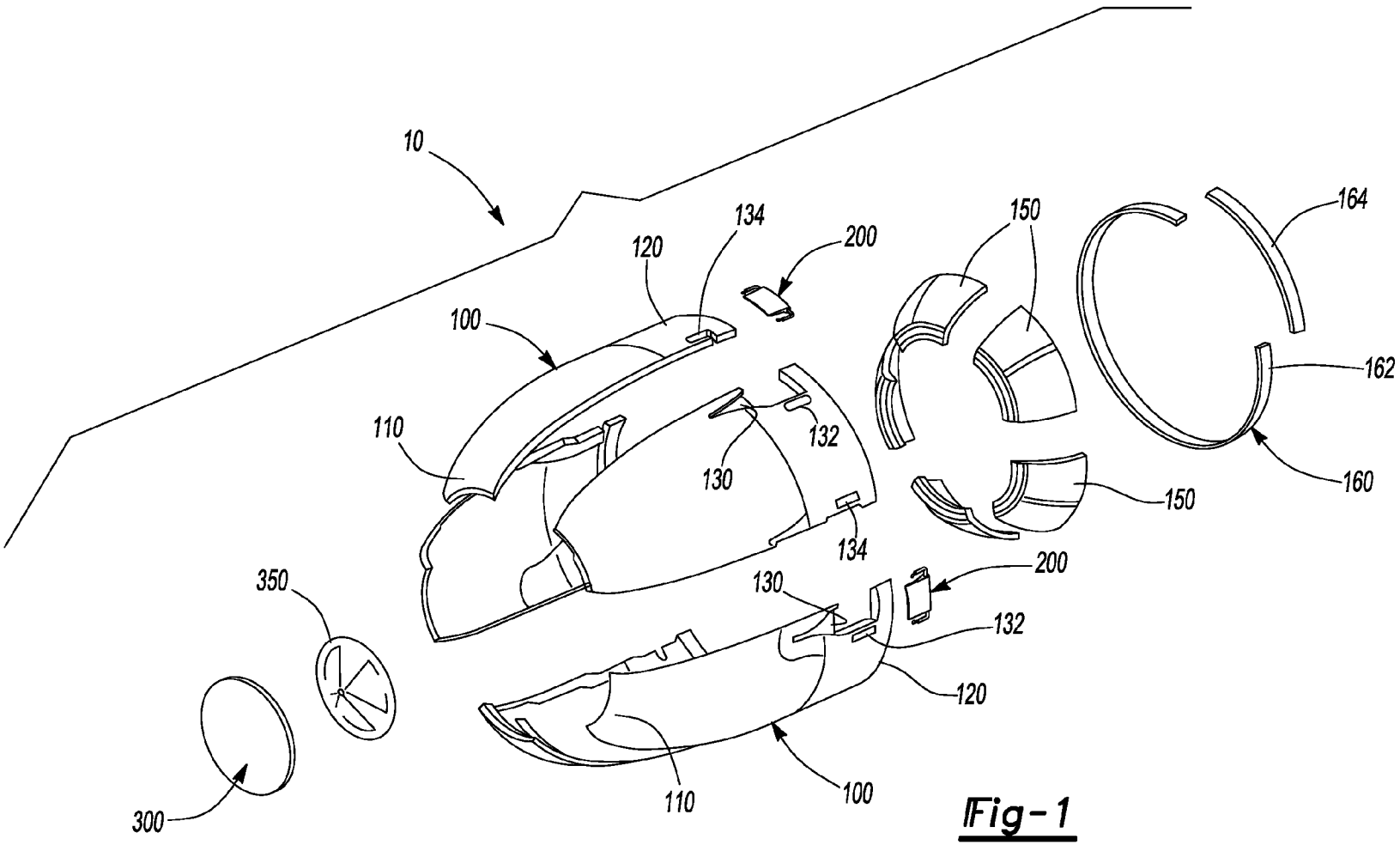
FIG. 1 is an exploded perspective view of an embodiment of a removable protective nose cover.

Turning now to FIG. 1, an exploded view of an embodiment is shown generally at reference numeral 10. The removable nose cover can include a plurality of shell members 100, each shell member 100 having a front end 110 and an aft end 120. Proximate to the aft end 120 can be a submerged inlet duct 130, a first clip slot 132 and a second clip slot 134. It is appreciated that the first clip slot 132 and the second clip slot 134 may or may not be associated with and/or proximate to the same submerged inlet duct 130 for a given shell member 100. The submerged inlet duct 130 affords for the flow of a fluid exterior to the shell member 100 to pass through the duct 130 and enter into an interior side of the shell members 100. A given submerged inlet duct 130 can be made from or can span across at least part of two adjacent shell members 100 as illustrated in FIG. 1, however this is not required. Proximate to the submerged inlet duct 130 can be an attachment clip 200 that is operable to fit at least partially within the first clip slot 132 and the second clip slot 134. The assembly of the shell members 100 using a plurality of attachment clips 200 provides for the securement of the aft ends 120 of the shell members 100 about the nose section of a submersible structure (not shown).

A central nose member 300 can also be included, the central nose member dimensioned such that it affords for attachment to each of the forward ends 110 of the shell members 100. Optionally included can be pieces of foam 150 and/or 350 in order to provide cushioning of the shell members 100 and central nose member 300 against the nose section of the submersible structure. In addition, the pieces of foam 150 and/or 350 can provide an outer projecting force or pressure to shell members 100 and/or central nose member 300 when the removable protective nose cover 10 is assembled about a submersible structure. For the purposes of the present invention, the term "foam" can include any compressible and/or "rubbery" material, illustratively including natural rubber, cork, elastomers, polyurethane foam, extruded polystyrene foam and the like.

In addition, a seal 160 having a first seal member 162 and a second seal member 164 can be located proximate to the aft end 120 of the shell members 100 in order to provide the same cushioning and/or outer projecting force on the aft ends 120 and limit the amount of fluid flow that can pass or flow from under the shell members 100 after flowing into the submerged inlet ducts 130. The seal 160 also maintains pressure on the submersible structure or an instrument package and thereby resists any tendency for the assembled protective nose cover from sliding off the nose through handling of the structure.

Figure 2:
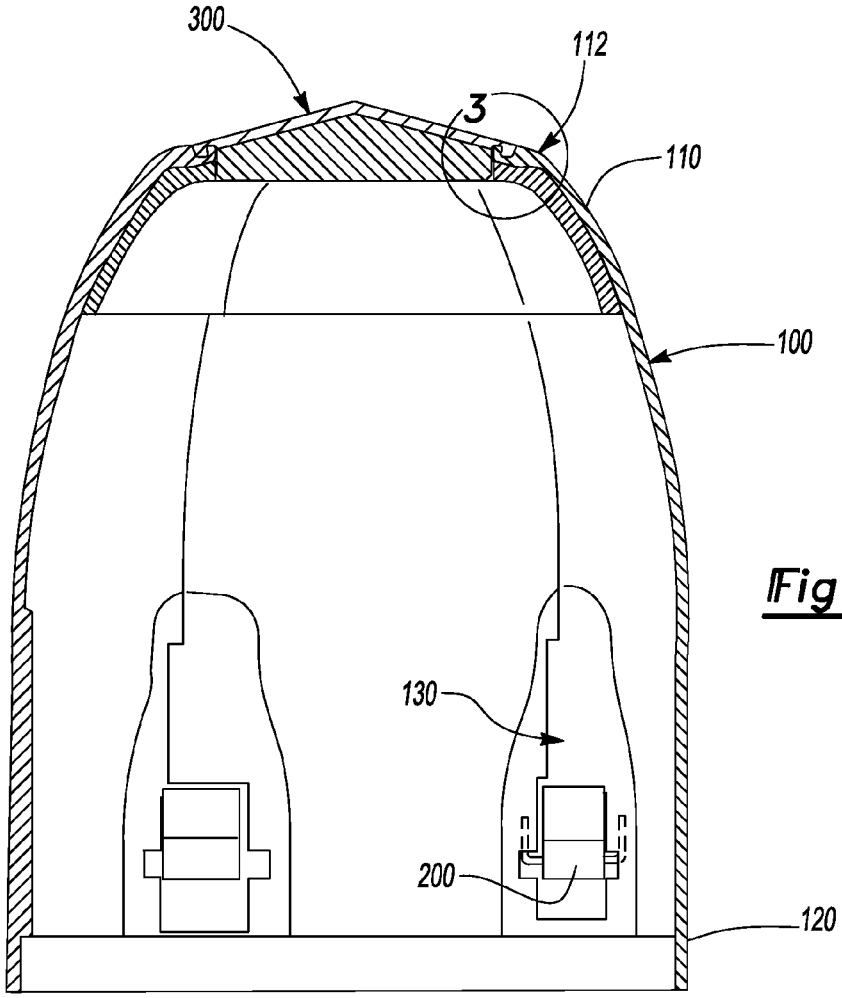
FIG. 2 is a side cross-sectional view of the embodiment shown in FIG. 1 with the protective nose cover in an assembled configuration.
Figure 3:
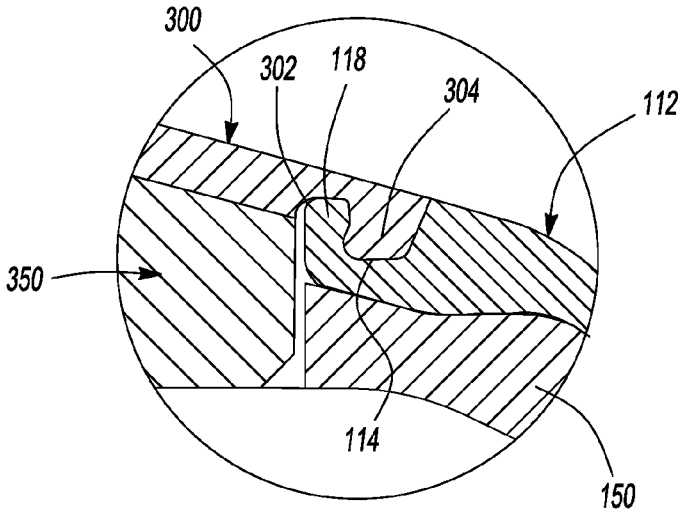
FIG. 3 is an enlarged view of the section 3 labeled in FIG. 2.

Turning now to FIG. 2, an inner side of the removable protective nose cover 10 in an assembled configuration is shown wherein the central nose member 300 and the attachment clips 200 are shown to be attached to the shell members 100. An enlarged section of the attachment of the central nose member 300 to the forward end 110 of a shell member 100 is illustrated in FIG. 3. As shown in this figure, the nose member 300 has an undercut region 302 and an extending member 304 which form a slot and allows a tang 118 on the forward end 110 to engage and/or snap into the undercut 302. The tang 118 is formed at least partially by a U-shaped recess 114 at the forward end 110 of the shell member 100. The extending member 304 of the central nose member 300 fits at least partially within the U-shaped recess 114 of the forward end 110. Likewise, fitting within the undercut region 302 of the central nose member 300 is the tang 118 of the shell member 100. It is appreciated that the U-shaped recess 114, the extending member 304, the undercut region 302 and the tang 118 are dimensioned such that a snap or interference fit can be provided between the central nose member 300 and the forward end 110 of each the shell members 100.

Turning now to FIGS. 4-6, an enlarged view of the attachment clip 200 is shown. The attachment clip 200 can include a top surface 210 and a bottom surface 220. The top surface 210 faces outwardly from the submersible structure, while the bottom surface 220 is oppositely disposed therefrom. The bottom surface 220 can include an inclined surface 222 that adjoins a forward end 202 of the attachment clip 200 to a base section 224. Adjacent to the base section 224 can be a spring section 226. At least partially within the attachment clip 200 can be a spring 230, the spring 230 providing tension or resistance to the movement of the attachment clip 200 relative to the spring 230.

In some instances, the spring 230 can pass at least partially through the spring section 226 as shown in FIG. 6. Although not required, the spring 230 can be made from an inner member 232 at least partially surrounded by an outer member 233. In some instances, the inner member 232 can be a metal wire and the outer member 233 can be a tube or pieces of tubing that fit around the metal wire. As shown in FIG. 6, the inner member 232 can include a plurality of bends 234 and at least one bend end 236.

The inner member 232 can also have a first end and a second end, the first end attachable to a shell member 100 on one side of the submerged inlet duct 130 and the second end attachable to a different shell member 100 on an opposite side of the same submerged inlet duct 130. It is appreciated that the plurality of bends 234 afford a U-shaped section 235, than when molded or placed within the spring section 236 provides a leverage section to resist movement or twisting of the bottom surface 220 relative to the spring 230. Thus holding the ends of the spring 230 in a fixed position provides resistance to the movement of the bottom surface 220, and in some instances a pivotal movement about or with respect to the bend end 236.

Referring back to FIG. 1, it is shown that the attachment clip 200 having the spring 230 can be used to attach adjacent shell members 100 to each other by inserting the ends of the spring 230 at least partially within the first clip slot 132 and the second clip slot 134. After insertion of the attachment clip 200 at least partially within the clip slots, it is appreciated that the attachment clip at least partially covers or extends across the submerged inlet duct 130. In addition, it is appreciated that the top surface 210 of the attachment clip 200 affords for normal/typical fluid flow thereacross. In contrast, the bottom surface 220 with the inclined surface 222, the optional base section 224 and spring section 226 afford for the trapping of fluid that flows through the submerged inlet duct 130 and under the attachment clip 200, thereby creating a local high pressure area underneath the attachment clip 200 and inside the nose cover 10.

The difference between the fluid flowing normally over the top surface 210 and the fluid being trapped underneath the bottom surface 200 creates a pressure difference across the bottom surface 220 that applies a torque to the attachment clip 200. When the torque is sufficiently large enough to overcome the retention strength of the spring 230, the attachment clip 200 releases and pops up in a direction that is generally perpendicular to and/or outwardly from the shell member 100. This release of the attachment clip 200 results in the two adjacent shell members 100 separating and the removal of the nose cover 10 from the submersible structure due to the higher pressure inside the shell and the lifting effect of the attachment clip 200.

It is appreciated that a pressure difference can exist across the bottom surface 220 due to the flow of air past the submersible structure and the removable protective nose cover 10 thereon. However, due to the low density of air, an insufficient pressure difference can be provided in order to release or flip the attachment clip 200. For example and for illustrative purposes only, air has a density of approximately 1.2 kg/m$^3$ at sea level and 20° C. As such, the top surface 210 and the bottom surface 220 can be subjected to differential in pressure therebetween of 60 kiloPascals (kPa) (8.7 pounds per square inch (psi)) for a weapon traveling at 1,225 kilometers per hour (km/h) (Mach 1) in air. In contrast, water has a density of approximately 998 kg/m$^3$ at sea level and 20° C. Therefore, assuming a water entry velocity for the weapon of 60 km/h (55 feet per second), the differential pressure between the top surface 210 and the bottom surface 220 can be approximately 121.3 kPa (17.6 psi). It is appreciated that a spring 230 can be selected and/or designed such that the attachment clip 200 will not be released as the weapon travels through air but will be released as the weapon enters into water.

It is appreciated that the embodiment shown in FIGS. 1-6 illustrates a nose cover shell built from five shell sections around a forward tapered section of a nose, with a sixth disk shaped section covering the front of the nose of a submersible structure. Inside the shell sections and the nose cover are foam inserts that can support the cover and help it to maintain its shape as well as cushion the forces being applied to the nose instrumentation during impact with the water upon entry. The seal 160 can be a silicon rubber sealing strip that limits the amount of fluid flow that can flow out from under the shell and also helps keep the cover in place during handling. The attachment clips hold the aft ends of the shell sections together and with the use of the foam inserts provides a removable protective nose cover that is held in tension around the submersible structure. After one shell section is removed upon entry of the submersible structure into water, restraining force is no longer present to hold the remaining shell sections in place, thereby resulting in their separation from the nose of the submersible structure also.

A process for removing the protective nose cover from the submersible structure can include providing the structure and providing the protective nose cover as detailed above. The plurality of shell members, the central nose member and the plurality of attachment clips are assembled about the submersible structure in order to form the protective nose cover with a plurality of submerged inlet ducts therewithin. Thereafter, the submersible structure can be placed into a liquid and moved through the liquid at a predefined speed. As the liquid passes through the plurality of submerged inlet ducts, a pressure differential is created on opposite sides of each of the plurality of attachment clips, the pressure differential exceeding a predefined value such that the clips are forced to move from the closed position to the open position. When the clips move to the open position, the plurality of shell members are no longer constrained to fit adjacent to the submersible structure's nose, and in combination with the fluid flow about the structure and the shell members, the protective nose cover is removed from the structure.

The shell members, central nose member and attachment clips can be made from any material known to those skilled in the art that provides the appropriate engineering properties for the given function of each component, illustratively including metals, alloys, plastics, ceramics, wood and the like.

The foregoing drawings, discussion and description are illustrative of specific embodiments of the present invention, but they are not meant to be limitations upon the practice thereof. Numerous modifications and variations of the invention will be readily apparent to those of skill in the art in view of the teaching presented herein. It is the following claims, including all equivalents, which define the scope of the invention.

I claim:

1. A removable protective nose cover for a submersible structure having a nose section, said removable protective nose cover comprising:

a plurality of shell members, each of said plurality of shell members having a forward end and an aft end, each shell member also dimensioned to fit adjacent to and around said nose section of the submersible structure forming a protective shell;

a submerged inlet duct, said submerged inlet duct at least partially within one of said plurality of shell members:

a central nose member having a locking member, said locking member operable to attach said central nose member to each of said forward ends of said plurality of shell members; and a plurality of attachment clips operable to attach adjacent aft ends of said plurality of shell members to each other, whereby attachment of said central nose member to each of said forward ends of said plurality of shell members and attachment of adjacent aft ends of said plurality of shell members to each other forms the removable protective nose cover for the submersible structure having the nose section.

2. The removable protective nose cover of claim 1, wherein said submerged inlet duct is formed by two attached and adjacent shell members.

3. The removable protective nose cover of claim 2, wherein said submerged inlet duct is formed by two adjacent aft ends of two attached and adjacent shell members.

4. The removable protective nose cover of claim 3, wherein at least one of said plurality of attachment clips is proximate said submerged inlet duct.

5. The removable protective nose cover of claim 4, wherein said at least one attachment clip covers at least part of said submerged inlet duct.

6. The removable protective nose cover of claim 5, wherein each of said plurality of attachment clips has a first end and a second end, said first end attachable to a first shell member on one side of said submerged inlet duct and said second end attachable to an adjacent second shell member on an opposite side of said submerged inlet duct, whereby attachment of said first and second ends of an attachment clip to said first and second shell member positions said attachment clip to cover at least part of said submerged inlet duct.

7. The removable protective nose cover of claim 1, wherein said central nose member has an undercut region and said forward end of each of said plurality of shell members has a tang dimensioned to fit at least partially within said undercut region, whereby said undercut region and said tang provide an interference fit between said central nose member and each of said forward ends of said plurality of shell members.

8. The removable protective nose cover of claim 1, further comprising a central nose foam piece, said central nose foam piece dimensioned to fit between said central nose member and the nose of the submersible structure, whereby said central nose foam piece fitting between said central nose member and the nose of the submersible structure provides an outward force onto said central nose member.

9. The removable protective nose cover of claim 1, further comprising a plurality of shell member foam pieces, each of said plurality of shell member foam pieces dimensioned to fit between a shell member and the submersible structure, whereby said plurality of shell member foam pieces fitting between said plurality of shell members and the submersible structure provides an outward force onto said plurality of shell members.

10. A removable protective nose cover for a submersible structure having a nose section, said removable protective nose cover comprising:

a plurality of shell members, each of said plurality of shell members having a forward end and an aft end, each shell member also dimensioned to fit adjacent to and around said nose section of the submersible structure forming a protective shell;

a plurality of submerged inlet ducts, each of said plurality of submerged inlet ducts formed by two attached and adjacent shell members each having said at least a portion of said submerged inlet duct therewithin;

a central nose member having a locking member, said locking member operable to attach said central nose member to each of said forward ends of said plurality of shell members;

a plurality of attachment clips operable to attach adjacent aft ends of said plurality of shell members to each other, whereby attachment of said central nose member to each of said forward ends of said plurality of shell members and attachment of adjacent aft ends of said plurality of shell members to each other forms the removable protective nose cover for the submersible structure having the nose section.

11. The removable protective nose cover of claim 10, wherein each of said plurality of submerged inlet ducts is formed by two adjacent aft ends of two attached and adjacent shell members.

12. The removable protective nose cover of claim 10, wherein each of said plurality of attachment clips at least partially covers one of said plurality of submerged inlet ducts submerged.

13. The removable protective nose cover of claim 12, wherein each of said plurality of attachment clips has a top surface and a bottom surface, said bottom surface located adjacent to the submersible structure when the removable protective nose cover is assembled onto the submersible structure, whereby liquid passing into each of said plurality of submerged inlet ducts creates a pressure difference between said top surface and said bottom surface of each of said plurality of attachment clips, the pressure difference seeking to move said bottom surface outwardly from the submersible structure.

14. The removable protective nose cover of claim 10, wherein each of said plurality of attachment clips has a spring, said spring operable to hold said bottom surface of each of said plurality of attachment clips adjacent to the submersible structure until a predefined pressure difference between said top surface and said bottom surface is exceeded.

15. A process for removing a protective nose cover from a submersible structure, the process comprising:

providing a submersible structure, the submersible structure having a nose section;

providing a protective nose cover for the submersible structure, the protective nose cover having:

a plurality of shell members, each of said plurality of shell members having a forward end and an aft end, each shell member also dimensioned to fit adjacent to and around said nose section of the submersible structure forming a protective shell and having at least a portion of a submerged inlet duct therewithin;

a central nose member having a locking member, said locking member operable to attach said central nose member to each of said forward ends of said plurality of shell members; and a plurality of attachment clips operable to attach adjacent aft ends of said plurality of shell members to each other, whereby attachment of said central nose member to each of said forward ends of said plurality of shell members and attachment of adjacent aft ends of said plurality of shell members to each other forms the removable protective nose cover for the submersible structure having the nose section;

assembling the plurality of shell members, the central nose member and the plurality of attachment clips about the submersible structure in order to form the protective nose cover onto the submersible structure, the protective nose cover having a plurality of submerged inlet ducts therewithin;

placing the submersible structure with the protective nose cover into a liquid;

moving the submersible structure with the protective nose cover through the liquid at a predefined speed such that the liquid passes through the plurality of submerged inlet ducts and releases at least one of the plurality of attachment clips, whereby releasing at least one of the attachment clips allows central nose member and the plurality of shell members to fall away from the submersible structure and be removed therefrom.

16. The process of claim 15, wherein each of the plurality of attachment clips have a top surface and a bottom surface, the bottom surface being adjacent to the submersible structure when the plurality of shell members, the central nose member and the plurality of attachment clips are assembled about the submersible structure.

17. The process of claim 16, wherein the liquid passing through the plurality of submerged inlet ducts creates a pressure difference between the top surface and the bottom surface of each of the plurality of attachment clips, the pressure difference being greater than a predefined value and resulting in the release of the at least one attachment clips.

* * * * *